US010612848B2

(12) United States Patent
Dovadola et al.

(10) Patent No.: US 10,612,848 B2
(45) Date of Patent: Apr. 7, 2020

(54) VERTICAL OVEN FOR MAINLY FLAT PARTS

(71) Applicant: CEFLA SOCIETÁ COOPERATIVA, Imola (IT)

(72) Inventors: Massimo Dovadola, Imola (IT); Cristian Giovannini, Imola (IT); Luigi Franzoni, Imola (IT)

( * ) Notice: Subject to any disclaimer, the term of this patent is extended or adjusted under 35 U.S.C. 154(b) by 0 days.

(21) Appl. No.: 15/774,213

(22) PCT Filed: Mar. 16, 2017

(86) PCT No.: PCT/IB2017/051536
§ 371 (c)(1),
(2) Date: May 7, 2018

(87) PCT Pub. No.: WO2017/158550
PCT Pub. Date: Sep. 21, 2017

(65) Prior Publication Data

US 2018/0372408 A1 Dec. 27, 2018

(30) Foreign Application Priority Data

Mar. 18, 2016 (IT) ..... 102016000028461

(51) Int. Cl.

| | |
|---|---|
| ***F26B 15/10*** | (2006.01) |
| ***F26B 15/14*** | (2006.01) |
| ***F26B 25/00*** | (2006.01) |
| ***F27B 9/02*** | (2006.01) |

(52) U.S. Cl.
CPC ..... *F26B 15/10* (2013.01); *F26B 15/14* (2013.01); *F26B 25/004* (2013.01); *F27B 9/021* (2013.01); *F27B 9/022* (2013.01)

(58) Field of Classification Search
CPC ..... F26B 15/10; F26B 15/14; F26B 25/004; F26B 9/022; F27B 9/022
USPC ..... 34/500
See application file for complete search history.

(56) References Cited

U.S. PATENT DOCUMENTS

| | | | | | |
|---|---|---|---|---|---|
| 4,261,110 | A * | 4/1981 | Northway | F26B 25/001 | 34/216 |
| 4,663,860 | A * | 5/1987 | Beall | F26B 15/20 | 34/216 |
| 5,568,692 | A * | 10/1996 | Crompton | F26B 3/283 | 34/270 |
| 5,632,097 | A * | 5/1997 | Snitchler | F26B 17/006 | 34/166 |

(Continued)

FOREIGN PATENT DOCUMENTS

| | | | | |
|---|---|---|---|---|
| CA | 3004860 A1 * | 9/2017 | F27B 9/022 | |
| DE | 1299550 | 7/1969 | | |

(Continued)

*Primary Examiner* — Stephen M Gravini
(74) *Attorney, Agent, or Firm* — Themis Law

(57) ABSTRACT

A vertical oven for panels includes trays configured to support mainly flat panels arranged in a multiple of two stacks circulating in opposed directions, such as the first stack moving in an ascending direction and the second stack in a descending direction. The trays are arranged at a distance from each other and the movement of the trays is such that at least one every other tray is withdrawn from the circulation, doubling the distance between the trays.

13 Claims, 4 Drawing Sheets

(56) References Cited

Figure 1:
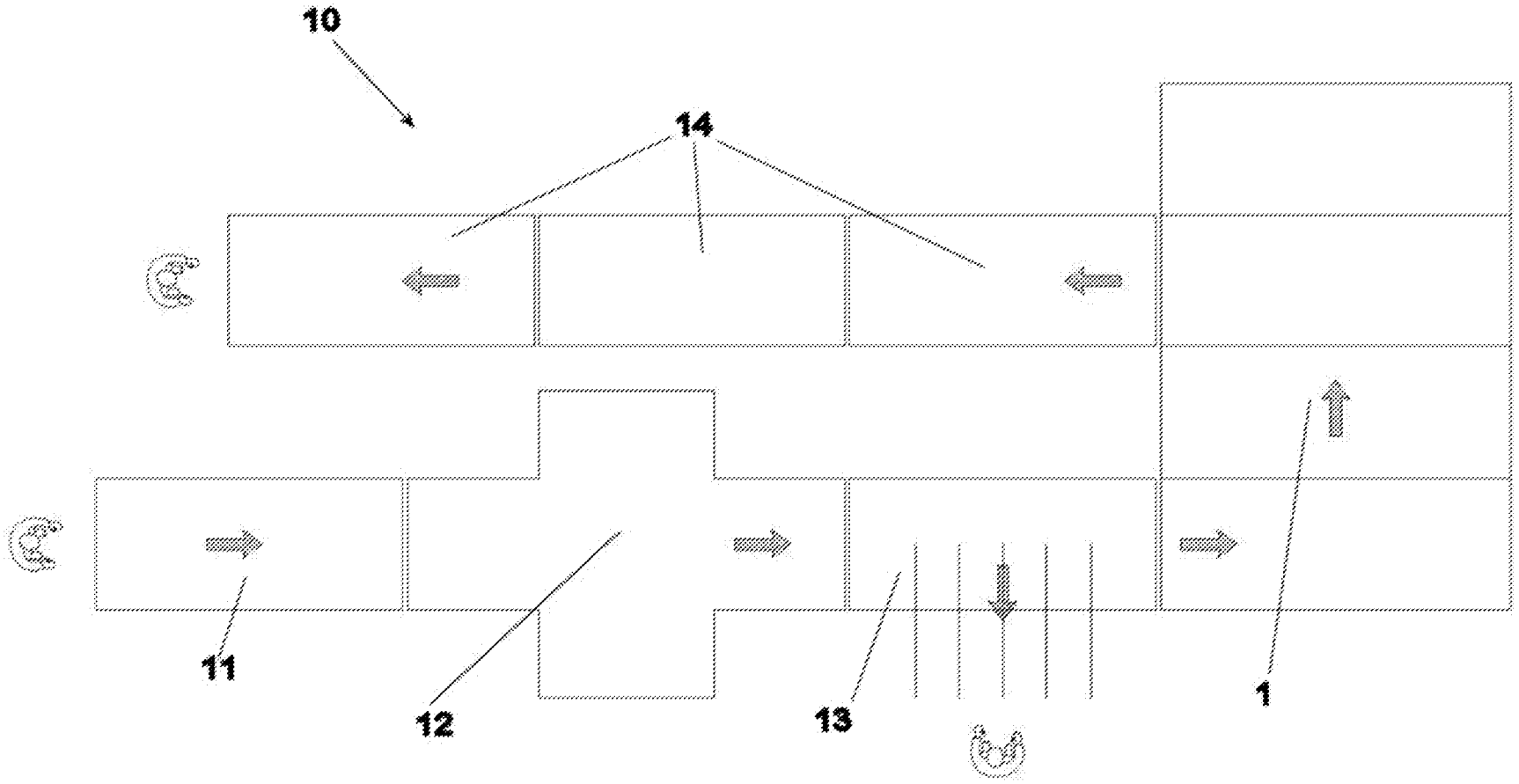

U.S. PATENT DOCUMENTS 5,915,815 A * 6/1999 Moore ..... F26B 25/006 34/132
5,921,002 A * 7/1999 Scheufler ..... B01D 46/00 34/269
6,751,885 B2 * 6/2004 Franzoni ..... F26B 15/10 34/216
7,926,197 B2 * 4/2011 Zoppas ..... B05D 1/18 126/110 C
8,266,812 B2 * 9/2012 Weisselberg ..... C10L 9/083 110/218
8,726,538 B2 * 5/2014 Weisselberg ..... F26B 17/003 110/248
8,850,712 B2 * 10/2014 Laviolette ..... F26B 5/042 118/634
9,423,179 B2 * 8/2016 Wieland ..... F26B 15/14
9,970,706 B2 * 5/2018 Wieland ..... F26B 25/008
10,064,416 B2 * 9/2018 Lagares Corominas ..... A23B 4/031
10,362,791 B2 * 7/2019 Lagares-Gamero ..... F26B 21/004
2002/0000050 A1 * 1/2002 Goldack ..... F26B 15/10 34/444
2018/0372408 A1 * 12/2018 Dovadola ..... F27B 9/022

FOREIGN PATENT DOCUMENTS

EP 2213178 A1 * 8/2010 ..... A23B 4/03
EP 2796059 B1 * 6/2017 ..... A23B 4/031
WO WO-2010086702 A1 * 8/2010 ..... A23B 4/03
WO WO-2017158550 A1 * 9/2017 ..... F27B 9/022

* cited by examiner

VERTICAL OVEN FOR MAINLY FLAT PARTS

The present invention relates to the technical field of ovens for drying paint applied on products; in particular, the invention relates to ovens for drying mainly flat parts (panels), both made of wood and its derivatives and plastics, metal, fibrocement and similar materials.

Said products typically have a length over 6 metres, a width up to 1300-1500 mm, and a thickness 5 to 300 mm.

Said ovens work at temperatures suitable for treating painted materials; said temperatures are typically in the range of 30° C.-120° C.

Said ovens are well known in the art, being e.g. described in the utility model IT221807 of the same applicant, in EP2609021B1 of Haenel or in GB2078651 of Lienhard. In said documents, vertical ovens for drying panels are described, having trays moved through motorized belt conveying systems or combined (slat and belt) conveying systems, i.e. wherein trays can be moved by suitable motor drive means fixed to oven frame, to allow the loading and unloading of panels.

Typically, vertical ovens with trays comprise a plurality of superimposed trays in a plurality of adjacent stacks inside transit chambers of the oven, along which transit chambers the trays are shifted through lifting chains. When a tray reaches the top of an ascending transit chamber (i.e. in which the chain moves trays towards the top), it is shifted on the top of a descending transit chamber (in which the chain moves the trays towards the bottom) through suitable devices for horizontal shifting. Through similar devices, at the end of the last descending transit chamber, the trays are shifted to the base of the first ascending transit chamber to be collected by the relative lifting chain. In this way, each oven tray follows a complete path through the entire oven, during which the panels, arranged on the trays, dry.

The loading and unloading of the panels on trays occurs thanks to the fact that the trays are moved through a motorizable conveying system, which allows to automatically load and unload the panels, without the need to extract the tray from the oven.

The shape of vertical ovens, having a plurality of superimposed trays, allows a good storing capability with a limited footprint, allowing a dwell time inside the oven itself that can vary from some ten minutes to over a couple of hours, according to production line speed and dimensions of the oven itself.

In their simplest embodiment, vertical ovens comprise two transit chambers; nonetheless other embodiments are known, comprising a plurality of transit chambers, typically a multiple of a couple of transit chambers, i.e. e.g. from two to six transit chambers. Such ovens are described e.g. in IT MI97A000463 Elmag and IT1309018 CEFLA. In such ovens, the trays typically follow a meandering path, and are habitually loaded and unloaded from their outer transit chambers.

The above kind of construction is common to the oven according to the present invention.

Typically, panels need be painted on both their main surfaces, and this entails a double passage in the oven. To this end, an oven having two transit chambers and three transit chambers is convenient, as will be better clarified in the following description of FIG. 2.

In the known oven having three chambers and two stacks, the trays are arranged on two stacks, each stack is housed inside one transit chamber, while a central space of the oven forming the third chamber is not used. Moreover, the distance between two superimposed trays is linked to chain pitch, and this allows to load panels up to a predetermined thickness, typically 70 mm. Should panels having a higher thickness need to dry, such ovens cannot be used.

The present invention aims to provide a vertical oven for drying painted products, mainly flat products, which allows a better load capacity, if possible without increasing their footprint, and having a limited additional cost.

A further aim of the present invention is to provide a vertical oven allowing to load and dry painted products, mainly flat products such as panels, having a thickness (i.e. their smaller dimension) bigger than the standard thickness of 70 mm.

This object is achieved by an apparatus and a method having the features of the independent claims 1 and 10. Advantageous embodiments and refinements are specified in claims dependent thereon.

The aim is achieved using a different path of the trays with respect to the known art, allowing to increase the distance between trays, and providing a parking place for trays which are withdrawn from the stacks in the transit chambers of the oven and which dwell inside the said chambers on the drying path.

In a generic embodiment, the oven comprises a number of transit chambers and corresponding stacks greater than two, and conveying means conveying a sequence of trays, the trays being positionable at a pre-set distance to each other. The trays of said sequence are moveable by said conveying means in the direction of the vertical extension of the transit chambers, in an ascending and descending direction, and from a transit chamber to another along a closed path, while in a position adjacent to at least one of oven's transit chambers there is provided at least a further parking area, which has a shape similar to a transit chamber. In the parking area at least some of the trays of the said sequence of trays can be transferred, which according to a pre-set scheme of transfer are withdrawn from said sequence.

Said at least one parking area, i.e. parking chamber, can be provided, or not, with heating means, and can have the function of temporary removal of some trays from the trays sequence only, according to the pre-set scheme. Alternatively, it can have the function of modifying the drying times of the products supported by the trays in a pre-set and controllable way, beyond the drying time provided for the passage of said trays along a path through one or more of the transit chambers of said oven.

Always according to a further feature, the oven is provided in combination with a control unit executing a control program, having a man-machine interface for the input of commands or data, and for visualizing information about the thermal treatment process. Said control unit controls the transfer devices and applies the withdrawal and/or re-insertion of pre-set trays of the sequence of trays from and/or into the path defined by the conveying means.

Different schemes of withdrawal and re-insertion can be provided and set up, as well as different dwelling time of the trays in the parking area, which are defined according to the specific treatment requirements thanks to a set up program. The set up program can comprise either a manual setting input interface or an automated definition program of the scheme of the trays to be withdrawn and of the times of withdrawal from a stack in a transit chamber, the times of duration of the parking in the parking chamber and the times of re-insertion of the trays in the stack in one transit chamber. This automated program may consider the provided number of products to be treated, their dimensions and treatment parameters in order to compute the above setting parameters of the process of withdrawing trays from stacks in the transit chambers, parking and reinserting trays in stack in a transit chamber.

In a more specific implementation, two main embodiments are provided:

1. In the first embodiment, the oven has three chambers and two stacks of trays each one moving in a transit chamber. The third central chamber, typically empty, is used to park the trays, which can be loaded or unloaded by transferring means under the control of the control unit. When every other tray is parked (i.e. every second tray in the stack), the distance d between two consecutive trays doubles. This increase in distance between trays in the stacks transiting in the transit chambers allows to load the trays with panels having a thickness up to about 200 mm, or anyway having a thickness higher than standard thickness.

When the trays are removed from their normal path, the oven can be loaded with panels having a higher thickness. If the central trays are loaded, they can be loaded with panels having standard thickness, which can dwell inside the oven for any time, independently from the transit time of the oven.

2. In the second embodiment, the oven has a multiple of two transit chambers and two stacks of trays other than one (e.g., four chambers and four stacks, or six chambers and six stacks). An empty space is provided next to the existing chambers, forming a parking chamber wherein every other loaded or unloaded tray is parked, so that the distance d between shifting trays doubles (2d). Now the oven can be used like in the first embodiment, to load panels with a higher thickness. The parking area can also host loaded trays, and in this case can must be heated.

The advantages of the present invention are linked to the possibility of using a structure of oven already in use exploiting all the loading capacity of the oven. This has different consequences:

Possibility to dry panels having a thickness higher than standard thickness, which normally cannot dry in an oven, and the possibility to perform drying cycles having different duration.

In one of the embodiments, the footprint being equal, the possibility to perform drying cycles having different duration.

Figure 2:
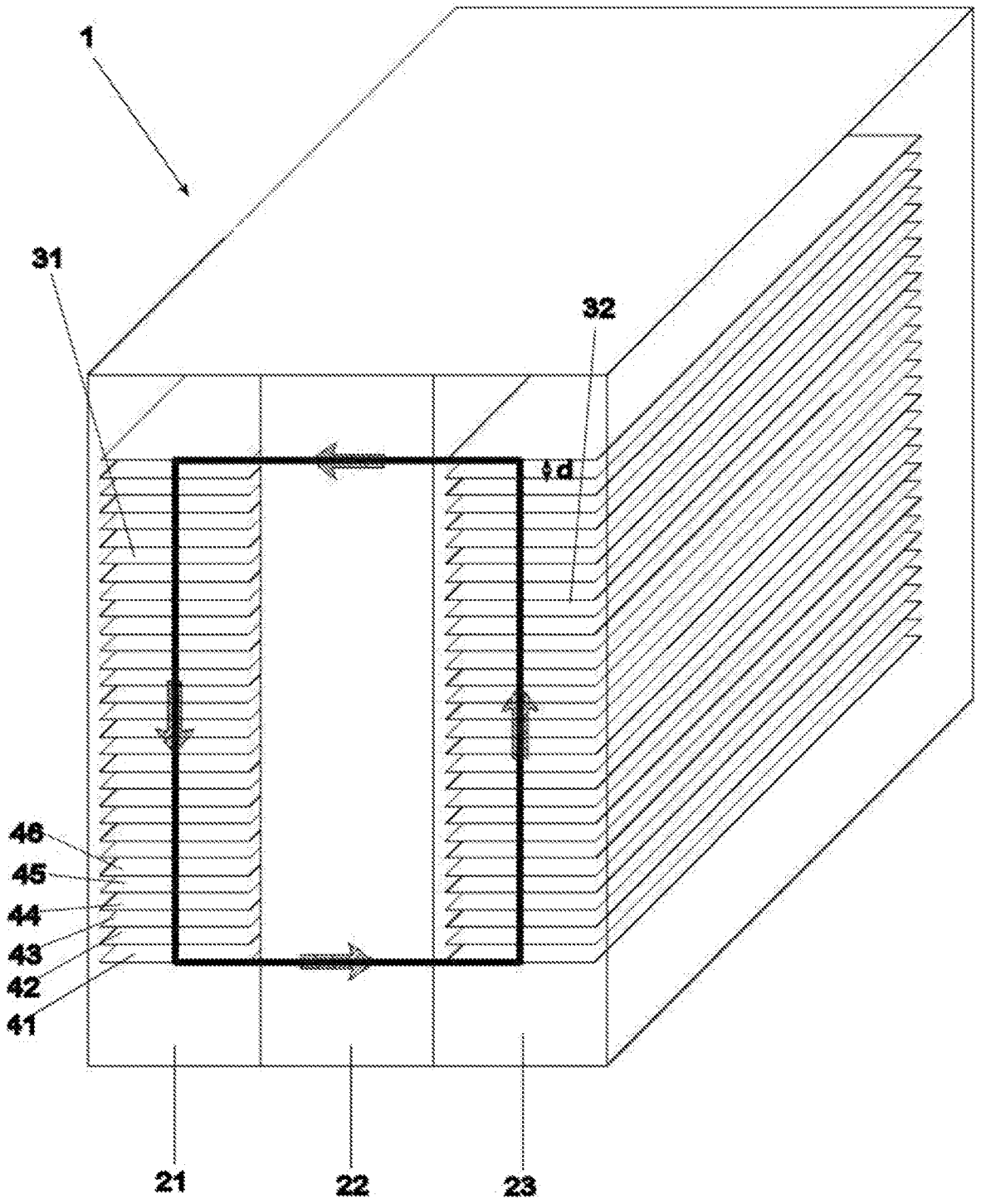
PRIOR ART FIG. 2
Figure 3:
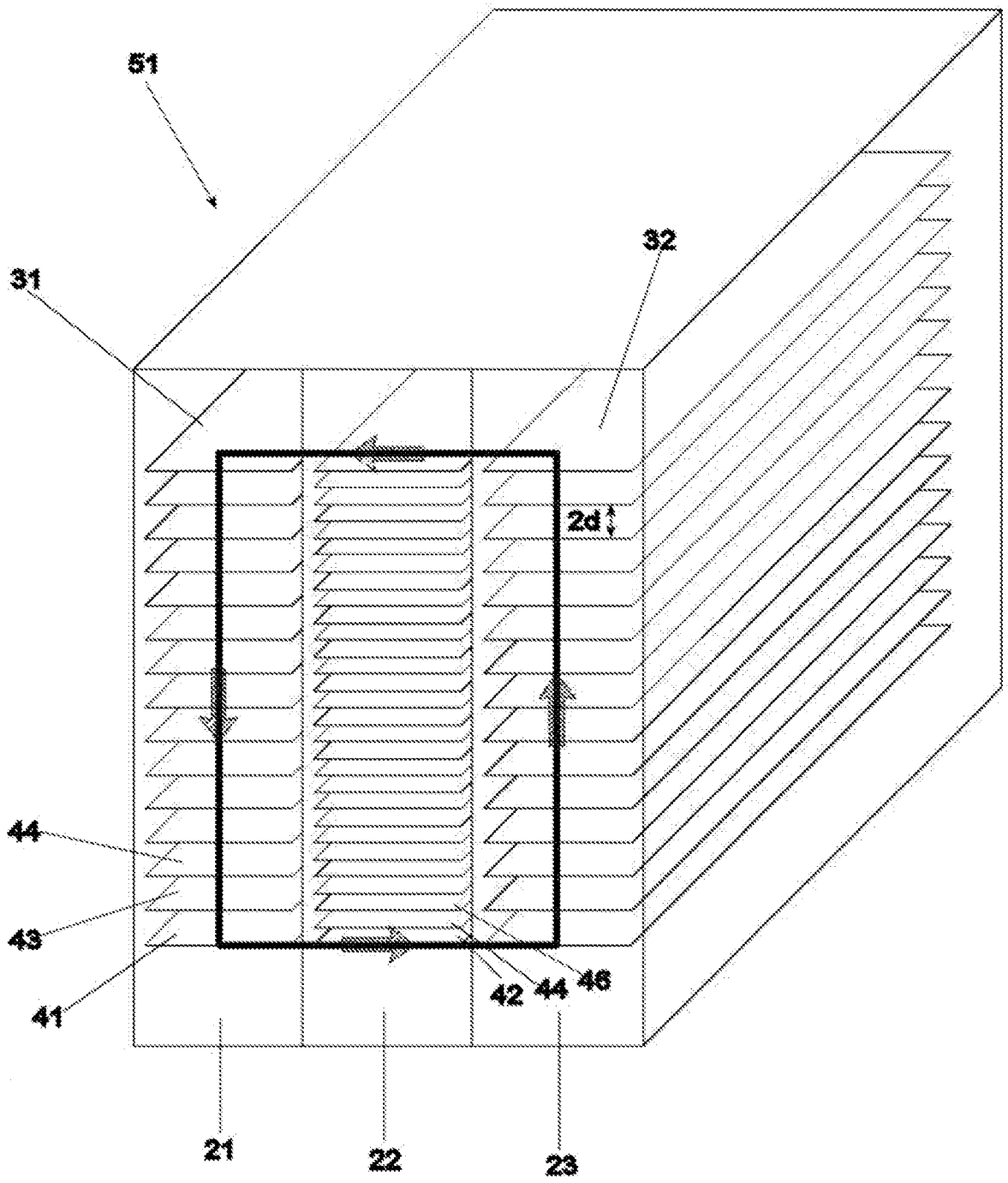
Figure 4:
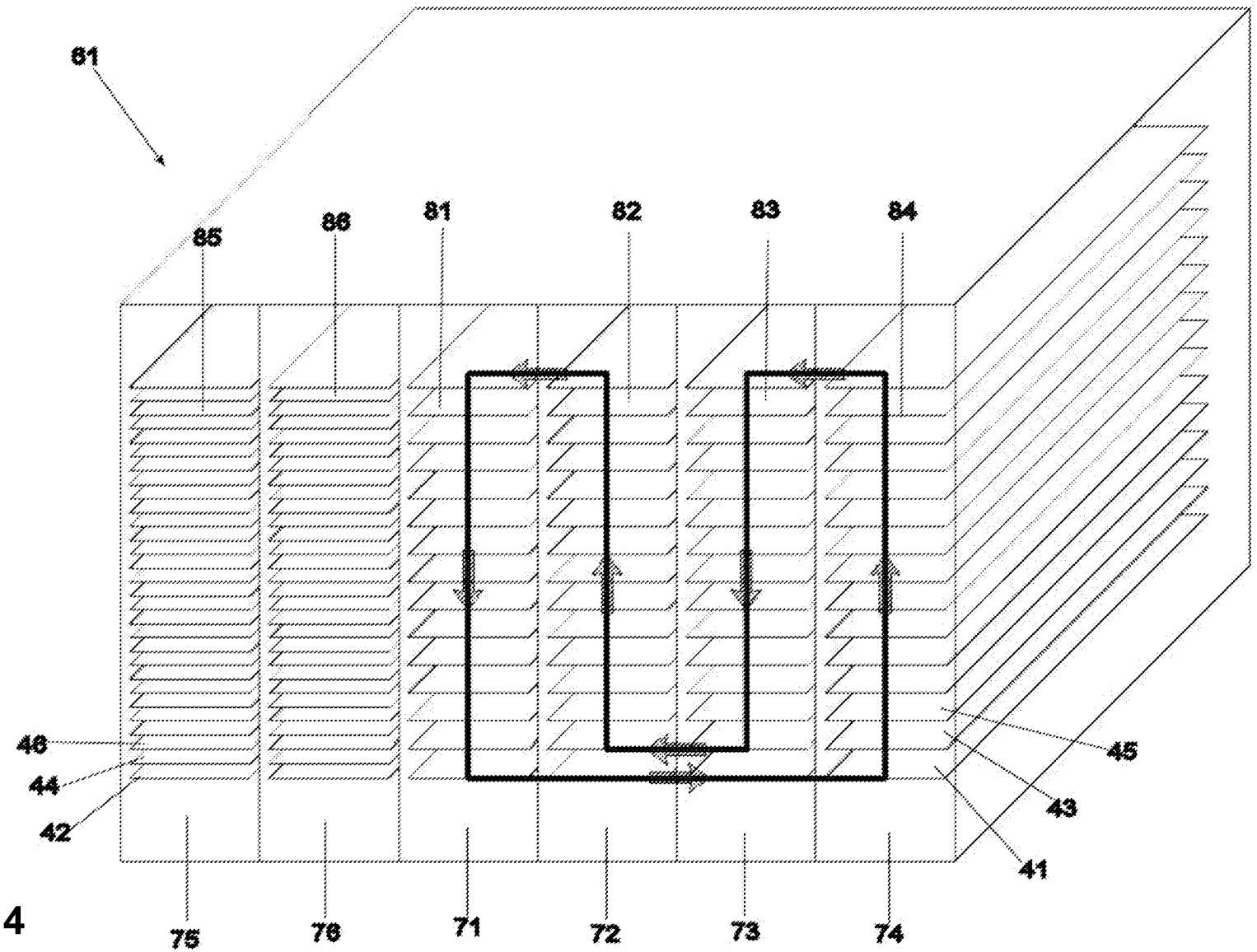

Further advantages and properties of the present invention are disclosed in the following description, in which exemplary embodiments of the present invention are explained in detail on the basis of the drawings:

FIG. 1 Typical painting production line, in a top view;

FIG. 2 Oven with three chambers and two stacks according to the known art;

FIG. 3 First embodiment: oven having three chambers and two stacks;

FIG. 4 Second embodiment: oven having four/six chambers with external parking area.

The shown embodiments are meant as examples of the different and various possibilities of plant configuration, and in particular of the oven according to the present invention, as well as of its possible multiple operating modes. The embodiments illustrated and discussed in this specification are intended only to teach those skilled in the art the best way known to the inventors to make and use the invention. Nothing in this specification should be considered as limiting the scope of the present invention. Modifications and variations of the above-described embodiments of the invention are possible without departing from the invention, as appreciated by those skilled in the art in light of the above teachings. It is therefore to be understood that, within the scope of the claims and their equivalents, the invention may be practiced otherwise than as specifically described, the configuration being determined by the requirements of treatment of the products to be dried and of their shape and dimension features.

Different features provided in combination with a specific embodiment may be provided also in combination with other embodiments. This particularly relates to the number and relative position of the transit chambers and of the parking chambers of the different embodiments shown in the figures. As it will appear from the following description, the lateral position of the one or more parking chambers may apply to the embodiment having only two transit chambers as well as the intermediate positioning of at least one parking chamber between two transit chamber may apply also to the embodiment showing four of more than four transit chambers.

When more than one parking chamber is provided, also a combination of the said lateral and intermediate positioning of one parking chamber may be applied to both the embodiments with only two and with more than two transit chambers.

FIG. 1 shows a typical painting production line 1 comprising a typical vertical oven 1. Typically, the (not shown) panel, loaded on a conveying system 11, is painted in a spraying booth 12 and from that point conveyed through a conveying system 13 to an oven 1 for drying. The panel is automatically loaded on a tray of the oven 1, lifted, horizontally shifted, and then lowered to be finally unloaded from the same loading side 14, to be conveyed to the painting booth again.

FIG. 2 shows a typical oven 1, wherein three transit chambers 21, 22, 23 and two stacks 31, 32 according to the known art are formed inside respectively two of the said three chambers which are indicated as transit chambers 21, 23. Each stack 31, 32 is provided with a plurality of trays 41, 42, 43, 44, 45, 46, . . . for loading panels, arranged in two stacks 31, 32. When a tray 41 reaches the top of the ascending chamber 23, it is shifted on the top of the descending chamber 21 through suitable horizontal shifting devices, for example as the one disclosed above in relation to the prior art documents. With similar devices, at the end of the last descending chamber, the trays are shifted to the base of the first ascending chamber 23 to be taken from the relative lifting chain. In this way, every tray of the oven follows a complete path through the entire oven, as shown with the arrows, during which the panels arranged on trays dry. As can be clearly observed from FIG. 2, the central chamber 22 is empty.

The path of the trays is normally closed while the dried objects may be loaded and unloaded at an input and at an output port of the said transit chambers, preferably at the bottom end of the said transit chambers.

FIG. 3 shows an oven 51 having three chambers 21, 22, 23 and two stacks 31, 32 according to the present invention. The oven 51 is substantially equal to the oven 1 of the known art, with the difference that the panels in oven 51 can perform two different paths:

a first path equal to the known art;

a second path wherein odd trays 41, 43, 45 . . . follow the path of the known art along stacks 31, 32, while even trays 42, 44, 46, . . . , when charged with the (not shown) panels to be dried, are stored in the central parking chamber 22. Alternatively, empty even trays 42, 44, 46, . . . are parked in the central parking chamber 22.

This allows to double the distance between an odd tray 41 and its consecutive tray 43 (from d to 2d), which in turn allows to load the trays with panels having a thickness up to 200 mm, or anyway thicker than the standard thickness.

Moreover, this also allows to use the same oven 51 for two distinct drying processes at the same time, each having a different drying time:

The panels loaded on odd trays 41, 43, 45, . . . have a drying time equal to the panels following the normal path, which is substantially linked to oven's design parameters (a fixed time determined by chain features, distance between trays, conveying system, production line speed);

The panels loaded on even trays 42, 44, 46, . . . have drying times which can be freely chosen, in the sense that they can dwell in the central parking chamber 22 until the operator decides to re-insert them in the normal path and allow their unloading according to normal modalities.

In this way, the oven 51 according to the present invention allows to perform the drying of panels having different drying requirements, and moreover to dry panels having a thickness higher than standard, which normally cannot dry in an oven, the oven footprint being equal with respect to known art ovens.

On the other hand, FIG. 4 shows a second embodiment of the present invention, i.e. an oven 61 having four transit chambers 71, 72, 73, 74 and four stacks 81, 82, 83, 84, per se already known in the art. The invention adds to the oven a side couple of parking chambers 75, 76, wherein even trays 42, 44, 46, . . . are temporarily parked, while odd trays continue in their typical meandering path, as shown by the arrows.

In this embodiment, too, odds trays are spaced of a double distance 2d with respect to the habitual arrangement of trays. Therefore odd trays can host panels having a thickness higher than standard, continuing their meandering path with the standard time of oven 61. On the other hand, even trays 42, 44, 46, . . . can dwell in the two parking chambers 75, 76 for any desired time before being re-inserted in the normal path of trays to be unloaded after a desired time.

The two parking chambers 75 and 76 can, or cannot, be heated being provided or not with heating means.

In the embodiment wherein the two parking chambers 75 and 76 are heated, the working of the oven doubles as explained in paragraph 0031, and therefore in the same oven 61 panels having distinct drying time are loaded at the same time.

In the embodiment wherein the parking chambers 75 and 76 are not heated, they become simply a sort of parking area for even trays 42, 44, 46, . . . , which have to be removed from the normal meandering path in order to allow the loading of panels thicker than standard on odd trays 41, 43, 45, . . . following the normal meandering path with its characteristic time.

Concerning the conveying of trays, and the possibility of sending even trays in the parking area, the design of mechanical solution allowing to send the trays to two different directions is part of the known art for the skilled person, and therefore will not be discussed in detail.

When even trays are sent to parking area 22; 75, 76, different working possibilities are provided.

If the trays are loaded with panels, when loading a human operator, through man-machine interface, will have to possibility to input a dwell time inside the parking area that, as already explained, is independent from the cycle time characteristic of the oven. E.g. if the cycle time of the oven is one hour, the dwell time in the parking area could be two, three, . . . twenty-four hours according to operator's choice.

If the trays are unloaded, a human operator can deviate even trays to the parking area, which dwell there until they are manually called back in the cycle by the human operator.

1 three chambers, two stack oven according to known art
10 typical painting production line
11 loading device
12 spraying booth
13 conveyor to the oven
14 back conveyor to spraying booth
21, 22, 23 three chambers
31, 32 two stacks
41, 43, 45, . . . odd trays
42, 44, 46, . . . even trays
51 three chambers, two stack oven according to the present invention
61 four chambers, four stack oven according to the present invention
71, 72, 73, 74 chambers
81, 82, 83, 84 stacks

The invention claimed is:

1. A vertical oven for drying painted objects, the oven comprising:

at least two vertical transit chambers (21, 22);

a plurality of trays (41, 42, 43, 44, 45, 46, . . . ) configured to support the painted objects, the plurality of trays being arranged in a stack (31, 32; 81, 82, 83, 84) of superimposed trays within each of the at least two transit chambers (21, 22); and motorized tray conveyors that displace the trays along a path comprising at least an ascending portion inside a first transit chamber of the at least two transit chambers, a lateral shifting portion from the first transit chamber to a second transit chamber of the at least two transit chambers, and a descending portion inside the second transit chamber, wherein one or both of an input or output port are provided at a bottom of the at least two transit chambers, at which there is provided alternatively or in combination a loading unit, an unloading unit of the dried painted objects from the trays, and a conveyor shifting the trays from a lower end of the second transit chamber to a lower end of the first transit chamber for recirculating the trays along the path inside the at least two transit chambers, wherein the trays (41, 42, 43, 44, 45, 46, . . . ) have a predefined distance from each other in the stacks inside the at least two chambers (21, 22), wherein the vertical oven includes at least one parking chamber (23);

wherein the at least one parking chamber (23) is configured to temporarily park one or more of the trays (42, 44, 43) in a stack of parked superimposed trays;

wherein transferring devices adapted to withdraw trays from the stack of the first or the second transit chamber and feed the trays to the at least one parking chamber or for re-insertion of the trays in the stack of said first or said second transit chamber, and wherein a control unit controls the transferring devices to withdraw every second tray in the stack of the first or the second transit chamber and parks the withdrawn tray in the at least one parking chamber (23), thus doubling the predefined distance between the trays in the stack of the first or the second transit chamber (31, 32; 81, 82, 83, 84).

2. The vertical oven according to claim 1, wherein the at least one parking chamber (23) is positioned between the at least two transit chambers (21, 22).

3. The vertical oven according to claim 1, wherein the at least one parking chamber (75, 76) is arranged at one side of the path or of one of the at least two transit chambers (71, 72, 73, 74).

4. The vertical oven according to claim 1, wherein the vertical oven has only two transit chambers.

5. The vertical oven according to claim 1, wherein the at least two transit chambers are two or more pairs of transit chambers.

6. The vertical oven according to claim 1, wherein the oven is provided with two parking chambers (75, 76).

7. The vertical oven according to claim 1, wherein the at least one parking chamber (23, 75, 76) is provided with a heater.

8. The vertical oven (51, 61) for panels according to claim 1, wherein the trays (41, 43, 45, . . . ) having double the predefined distance from each other due to withdrawals of every second tray support panels having a higher thickness than other panels.

9. The vertical oven (51) according to claim 1, wherein the control unit is configured to set different dwelling times for the trays in the parking chamber.

10. A method of drying mainly flat painted panels comprising:

providing a vertical oven comprising:

at least two vertical transit chambers (21, 22);

a plurality of trays (41, 42, 43, 44, 45, 46, . . . ) configured to support the painted objects, the plurality of trays being arranged in a stack (31, 32; 81, 82, 83, 84) of superimposed trays within each of the at least two transit chambers (21, 22); and motorized tray conveyors that displace the trays along a path comprising at least an ascending portion inside a first transit chamber of the at least two transit chambers, a lateral shifting portion from the first transit chamber to a second transit chamber of the at least two transit chambers, and a descending portion inside the second transit chamber, wherein one or both of an input or output port are provided at a bottom of the at least two transit chambers, at which there is provided alternatively or in combination a loading unit, an unloading unit of the dried painted objects from the trays, and a conveyor shifting the trays from a lower end of the second transit chamber to a lower end of the first transit chamber for recirculating the trays along the path inside the at least two transit chambers, wherein the trays (41, 42, 43, 44, 45, 46, . . . ) have a predefined distance from each other in the stacks inside the at least two chambers (21, 22), wherein the vertical oven includes a parking chamber (23);

wherein the parking chamber (23) is configured to temporarily park one or more of the trays (42, 44, 43) in a stack of parked superimposed trays;

wherein transferring devices adapted to withdraw trays from the stack of the first or the second transit chamber and feed the trays to the parking chamber or for re-insertion of the trays in the stack of the first or the second transit chamber, wherein a control unit controls the transferring devices to withdraw every second tray in the stack of the first or the second transit chamber and parks the withdrawn tray in the parking chamber (23), thus doubling the predefined distance between the trays in the stack of the first or the second transit chamber (31, 32; 81, 82, 83, 84), wherein even trays (42, 44, 46, . . . ) in the stack follow a different path from a path of odd trays (41, 43, 45, . . . ) in the stack, and wherein the even trays (42, 44, 46, . . . ) are parked in a pre-set area (22; 75, 76) for any desired time, and wherein the odd trays are driven along a predefined path and with an increased distance between the odd trays (41, 43, 45, . . . ), the increased distance corresponding to a double distance of the stack before transferring the even trays into the parking chamber adjacent to the first and the second transit chamber.

11. The method according to claim 10, wherein the even trays (42, 44, 46, . . . ) in the parking chamber (22; 75, 76) support or do not support the panels.

12. The method according to claim 11, wherein if the even trays (42, 44, 46, . . . ) support the panels, the parking chamber (22, 75, 76) is heated.

13. The method according to claim 10, wherein a dwell time of the even trays (42, 44, 46, . . . ) in the parking chamber (22; 75, 76) is inputted by an operator when loading an oven containing the first and the second transit chamber, or is decided when reinsertion of the even trays (42, 44, 46, . . . ) is necessary.

* * * * *